US006915934B2

(12) United States Patent
Hassett

(10) Patent No.: US 6,915,934 B2
(45) Date of Patent: Jul. 12, 2005

(54) PROTECTIVE ENCLOSURE WITH A LINE-OUT DEVICE ADAPTED FOR USE WITH ELECTRONIC COMPONENTRY

(75) Inventor: Eric Hassett, Golden, CO (US)

(73) Assignee: CaseLogic, Inc., Longmont, CO (US)

( * ) Notice: Subject to any disclaimer, the term of this patent is extended or adjusted under 35 U.S.C. 154(b) by 112 days.

(21) Appl. No.: 10/409,463

(22) Filed: Apr. 7, 2003

(65) Prior Publication Data

US 2004/0129749 A1 Jul. 8, 2004

Related U.S. Application Data

(63) Continuation-in-part of application No. 29/171,089, filed on Nov. 15, 2002, now Pat. No. Des. 481,865.

(60) Provisional application No. 60/438,916, filed on Jan. 8, 2003.

(51) Int. Cl.[7] ..... A45F 3/02; B65D 85/00

(52) U.S. Cl. ..... 224/610; 206/726; 206/728; 224/612; 224/617; 224/930

(58) Field of Search ..... 224/235, 607, 224/610, 612, 617, 929, 930; 206/320, 701, 725–728; 361/814; 455/351

(56) References Cited

U.S. PATENT DOCUMENTS

| | | | | | |
|---|---|---|---|---|---|
| 3,017,567 | A | * | 1/1962 | Barringer | 224/930 |
| 4,411,267 | A | * | 10/1983 | Heyman | 224/930 |
| 4,770,328 | A | * | 9/1988 | Dickhudt et al. | 224/930 |
| 5,409,152 | A | * | 4/1995 | Trevino | 224/930 |
| 5,706,940 | A | * | 1/1998 | Amarello | 206/320 |
| 5,808,865 | A | * | 9/1998 | Alves | 206/320 |
| 6,006,915 | A | * | 12/1999 | Moor | 224/929 |
| 6,216,927 | B1 | * | 4/2001 | Meritt | 224/929 |
| 6,289,896 | B1 | * | 9/2001 | Hart | 206/701 |
| 6,345,751 | B1 | * | 2/2002 | Elliot | 224/930 |
| 6,349,824 | B1 | * | 2/2002 | Yamada | 206/316.1 |
| 6,352,186 | B1 | * | 3/2002 | Endo | 224/930 |
| D458,755 | S | | 6/2002 | Szyf | |
| D472,387 | S | | 4/2003 | Hassett | D3/301 |
| D472,706 | S | | 4/2003 | Hassett | D3/289 |
| D472,708 | S | | 4/2003 | Hassett | D3/301 |
| 6,659,320 | B1 | * | 12/2003 | Alves et al. | 224/930 |
| 6,712,249 | B2 | * | 3/2004 | Magnusson et al. | 224/930 |
| 6,772,883 | B2 | * | 8/2004 | Lindamood | 206/320 |
| D496,156 | S | | 9/2004 | Hassett | D3/218 |
| 2002/0088726 | A1 | * | 7/2002 | Chou | 206/320 |

OTHER PUBLICATIONS

Samsonite Backpacks New Jack Backpack, digital images from http://us.samsonite.com/webapp/us/servlet/SProduct-Display?productId=123256&storeId=10001&langId=1&pc=COL320 (Website believed to be updated Feb. 2003), printed Oct. 2004.

Print out from www.jansport.com of Backpack employing the "Live Wire" device (see also www.jslivewire.com), print out obtained Jun. 16, 2004 (product believed to be added to website Mar. 2003), 1 page.

* cited by examiner

*Primary Examiner*—Gary E. Elkins
(74) *Attorney, Agent, or Firm*—Sheridan Ross P.C.

(57) ABSTRACT

A protective enclosure capable of storing an electronic device while protecting it from damage emanating from impacts, impingements, dust and moisture is provided herein. More specifically, the present invention allows a user to use a portable electronic device without requiring the user to open the enclosure and expose the contents to inclement weather.

16 Claims, 5 Drawing Sheets

(Rotated 30° Clockwise)

(Rotated 30° Clockwise)

(Rotated 30° Clockwise)

PROTECTIVE ENCLOSURE WITH A LINE-OUT DEVICE ADAPTED FOR USE WITH ELECTRONIC COMPONENTRY

CROSS REFERENCE TO RELATED APPLICATION

This application is continuation-in-part of U.S. patent application Ser. No. 29/171,089, now Design Pat. No. D481,865, entitled COMPACT DISC PLAYER CASE, having a filing date of Nov. 15, 2002, and claims the benefit of U.S. Provisional Patent Application Ser. No. 60/438,916, entitled CASE EQUIPPED WITH LINE-OUT DEVICE, having a filing date of Jan. 8, 2003, both applications being incorporated herein by reference in their entirety.

FIELD OF THE INVENTION

The present invention relates to apparatus that are capable of securing and protecting an electronic device such as a compact disc player from abrupt impact and water damage, and which allows a user to gain limited access to the enclosure without jeopardizing the water resistant integrity of the device. More specifically, in one embodiment of the present invention an enclosure is provided which is adapted for holding a portable compact disc (hereinafter "CD") player and a plurality of CDs which includes an external connection port for a user interface, wherein a headset listening device can be selectively interconnected to an external portion of the enclosure.

BACKGROUND OF THE INVENTION

Storage cases and enclosures for transporting and protecting CD players, CDs, MP3 players, Personal Data Assistants (PDAs), mini-disc players, transistor radios, two-way radios, amplifiers, and cellular phones (hereinafter "electronic device") are commonly known. Traditionally, these enclosures are constructed from a resilient material such as nylon and in some embodiments include a clam-shell opening that is selectively secured with a zipper, a hook and loop fastener, or other type of securing device. Furthermore, some enclosures are capable of carrying both an electronic device and items used within the device, such as a CD player and a plurality of CDs. Depending on the material of construction, traditional enclosures provide a limited range of protection from impact, scratches, and water damage. Unfortunately, in order to provide such protection from the outside elements, the enclosure must be sealed, thereby preventing or restricting access to the electronic device.

Portable music listening devices allow people to enjoy music during outdoor activities. In order to enjoy music without disturbing others, a user must generally use a headset or ear piece(s). However, to gain access to ports on the electronic device, the enclosure must be opened which makes the contents more susceptible to damage, especially in inclement weather. Generally, a user will remove the electronic device and hold or clip it to a garment while participating in an activity. Alternatively, a user may try to exploit some of the protective aspects of a particular enclosure while listening to music. For example, a zipper on an enclosure may be opened partially to gain limited access, but the contents may fall out and be lost or damaged, especially during rigorous physical activity such as skiing, snow boarding, etc. Furthermore, any opening in the enclosure provides a pathway where fluids may come in contact with the electronic device and cause damage or destroy the sensitive electronic components.

Thus, there is a long felt need in the field of electronic device storage to provide a cost effective enclosure which is capable of protecting the internal contents from impact and external elements, while providing selective access to the electronic component via headphones or other similar devices such that the electronic device can be safely and effectively enjoyed without compromising the integrity of the enclosure.

SUMMARY OF THE INVENTION

It is thus one aspect of the present invention to provide a protective enclosure which is capable of storing an electronic device, such as a portable CD player, cassette player, radio or any other type of electronic device which is capable of transmitting information via a hard-line connected to headphones or other type of input or output device.

It is another aspect of the present invention to provide a "line-out" device, wherein a user can gain access to the electronic device without substantially breaching the integrity of the enclosure. For example, in one embodiment of the present invention an aperture is integrated into the enclosure along with a protective sheath interconnected to the enclosure in the same general location. This aperture provides access to the internal portion of the enclosure while the enclosure is substantially sealed to prevent water damage, or exposure to other external elements such as sand or dirt. In one embodiment, an auxiliary hard-line may be employed to span the distance between the aperture and the electronic device's listening port. The extension may also be adapted with an end housing which has a greater diameter than the transmission line. When inserted into the aperture and partially covered with the sheath, the thicker end creates a seal which substantially provides a barrier to fluid. Therefore, when the enclosure is closed, maximum protection against impact and water damage is provided, while the listening port is effectively transferred to the outside of the enclosure to provide an access port for the user's headset or other listening means. This feature is especially useful for snowboarders, skiers, runners, boaters, skaters, and other outdoor sports enthusiasts who are likely to encounter inclement weather.

It is yet another aspect of the present invention to provide a water and dust resistant enclosure for electronic devices, wherein the electronic device can be enjoyed without exposing the sensitive electronics to moisture, sand and other elements, such that electronic device can be enjoyed during outdoor activities, such as snow boarding. As mentioned above, the auxiliary extension line which fits snugly into the aperture integrated into the enclosure provides some protection, but more protection is easily achievable. In one embodiment, a gasket, which interfaces with the sheath and the enclosure, provides a more watertight seal. Alternatively, a means may be provided wherein an end of the auxiliary line is selectively interconnected to the enclosure to provide a more rigid, watertight, interface. In order to prevent fluids from entering through zippers, which may be integrated into the enclosure, other water proofing means may need to be employed. For example, in one embodiment, an additional flap of material is provided that is capable of folding over a closed zipper and is selectively interconnected to the enclosure, effectively hiding the zipper and providing additional protection to ensure the zipper stays selectively interconnected, and providing an additional fluid barrier. Alternatively, in another embodiment a selective interconnection which is inherently water proof is employed which is similar to those used on ZIP-LOC™ bags. Finally, the enclosure may be substantially constructed of water repellant or water proof materials to prevent fluid penetration through the "skin" of the enclosure.

It is another aspect of the present invention to provide an electronic device enclosure that is easy to transport such that it does not substantially interfere with the user's activities. For example, in one embodiment of the present invention, a strap is provided such that the enclosure can be selectively positioned over the user's shoulder or waist. Alternatively, belt loops, clips, or other attachment means may be provided for attachment to a backpack, coat pocket, etc. One skilled in the art will appreciate any number of attachment means can be utilized to allow a user greater freedom and mobility while using the protective enclosure and associated electronic device.

It is still yet another aspect of the present invention to provide access to an electronic device while it is enclosed and protected. The enclosure with the line-out feature, as described above, more effectively protects the enclosed electronic device. However, in order to effectively utilize various functions of the electronic device such as volume, song selection, etc., it may be necessary for a user to breach the main opening, thereby exposing the delicate electronic componentry to the elements. For example, a user may want to change the track of a CD, or make a two-way call while on a ski slope. By opening the enclosure to access the enclosed electronic device, the user increases the chance that snow will come in contact with the electronic device. As mentioned above, one embodiment of the present invention is constructed from resilient materials. If the user knows the general area of data input buttons on a particular electronic device, he or she can simply squeeze or press down on the resilient material to initiate a song change, for example. Although generally effective, the lack of visibility may be a problem in other situations. Also, the task may be more difficult if the user is wearing gloves wherein his or her sensation of touch is limited. Therefore, it is another embodiment of the present invention to provide a transparent viewing area in the enclosure to provide visibility to one or more buttons of the electronic device to allow a user to identify the desired buttons or function.

In another embodiment of the present invention, a flap is provided which is selectively interconnected to the enclosure body that allows limited access to the data entry buttons of the electronic device. A flap of water resistant material may be fastened to the enclosure with stitching, zippers, or hook and loop fasteners. As appreciated by one skilled in the art, any number of methods including those described above can be employed to the periphery of the enclosure to allow selective interconnection and limited access to the enclosure's contents. Furthermore, a section of resilient material may be integrated into an enclosure constructed from a rigid material, wherein a user could access the buttons of the electronic devices by pressing the less rigid resilient material. Alternatively, one or more rigid or flexible buttons may be provided which may be accessed from the exterior of the enclosure, but which provide operable communication to the various modes of selection provided on the electronic device.

It is a further aspect of the present invention that pockets are provided to store items in the same water resistant environment. In one embodiment of the present invention, pockets or sleeves are provided that are capable of receiving a plurality of CDs. Alternatively, other pockets on the inside and outside of the enclosure may be employed to protect items such as keys, money, ski lift passes, driver's licenses, credit cards, etc., from damage or loss.

It is still yet another aspect of the present invention to provide a protective enclosure that is constructed from known materials and thus inexpensive to manufacture. For example, one resilient embodiment of the present invention is constructed with one or a combination of water resistant materials such as nylon, Gore-TEX™, polypropylene, polyethylene, rubber, treated leather, elastic, and/or plastic. One skilled in the art will appreciate that any resilient material with varying water resistant properties, could be employed. In addition, padding such as foam rubber, is preferably added in various predetermined locations to increase the impact resistance of the enclosure. Alternatively, another embodiment of the present invention is constructed from rigid materials that further increase the impact protection aspect of the present invention. Finally, the enclosure of the present invention may be made in a plurality of shapes, sizes, materials of various colors, and may embody advertisements, logos, or endorsements.

Thus, it is one aspect of the present invention to provide an enclosure adapted for holding and protecting an electronic device, comprising:

a front portion selectively interconnected to a rear portion, wherein said enclosure may be selectively opened and closed;

an electronic device storage area positioned between said front portion and said rear portion;

an aperture in said enclosure which is adapted for allowing penetration of said enclosure by a conductive auxiliary cord; and a sheath interconnected to said enclosure, and which is adapted to receive and sealingly engage the conductive auxiliary cord.

DETAILED DESCRIPTION

Figure 1:
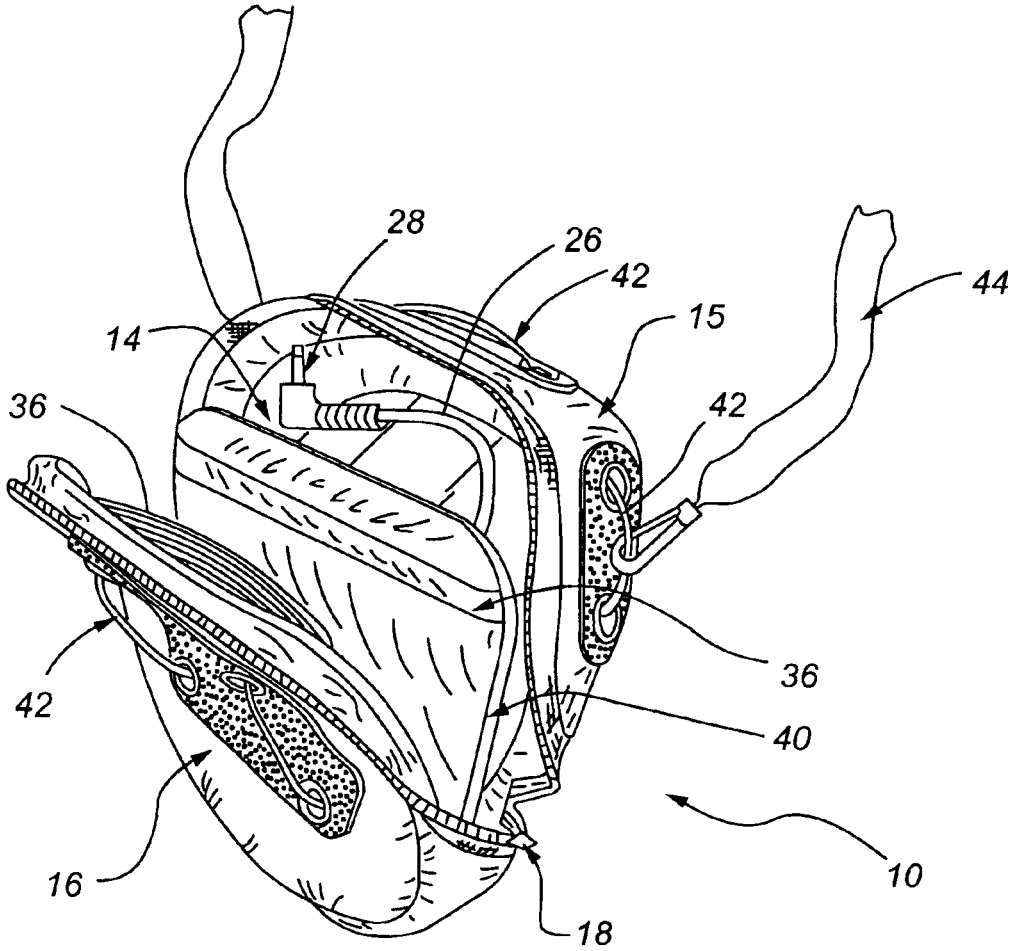
FIG. 1 is a rear perspective view of one embodiment of the present invention.

FIGS. 1–8 depict an enclosure capable of securing an electronic device and which protects the electronic device from impact, water and dust damage, and which includes a line-out jack which allows interconnection of headphones without opening the enclosure. More specifically, a CD player enclosure with a plurality of CD pockets is shown which holds the contents therein with a zipper. The line-out device provides selective access for a user's headsets, earpieces, or speakers, while maintaining closure of the main opening, to prevent infiltration of snow, rain, dust and other foreign objects.

Referring now to FIGS. 1–8, one embodiment of the present invention is shown herein. Generally, the electronic device protective enclosure 10 comprises a pouch which defines a compartment 14 that holds the electronic device. A front portion 15 and a rear portion 16 of the pouch are generally closed by a selectively securing means 18, for example a zipper, loop and hook type fasteners, etc. In one embodiment, the enclosure 10 is constructed from a compliant, water resistant material such as nylon. One skilled in the art will appreciate that other compliant or non-complaint water resistant materials may be used in the construction of the entirety or portions of the enclosure, including, but not limited to Gore-TEX™, polyethylene, poly propylene treated leather, plastic, neoprene, and other materials well known in the art. Preferably, a transparent or semi-transparent material 17 is integrated into the front portion 15 of the enclosure 10 which allows a user to see the electronic device or a ski lift attendant to see and scan a lift pass without opening the enclosure 10.

Figure 2:
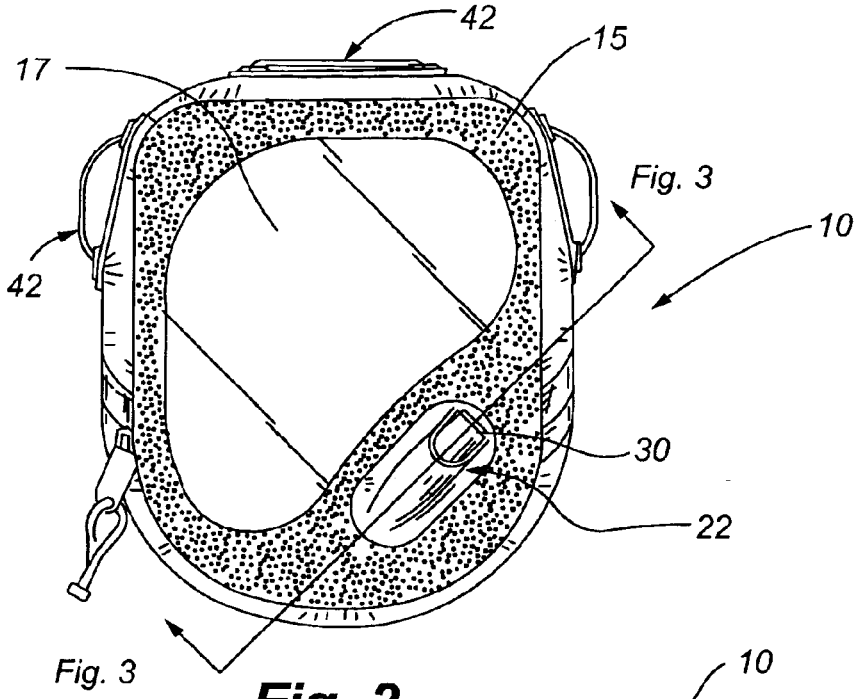
FIG. 2 is a front elevation view of the invention shown in FIG. 1.
Figure 3:
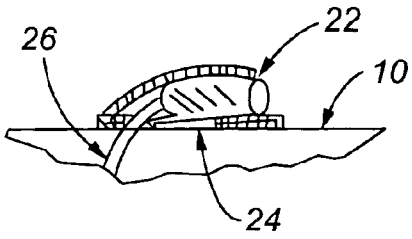
FIG. 3 is a partial auxiliary section view of the invention shown in FIG. 1.
Figure 4:
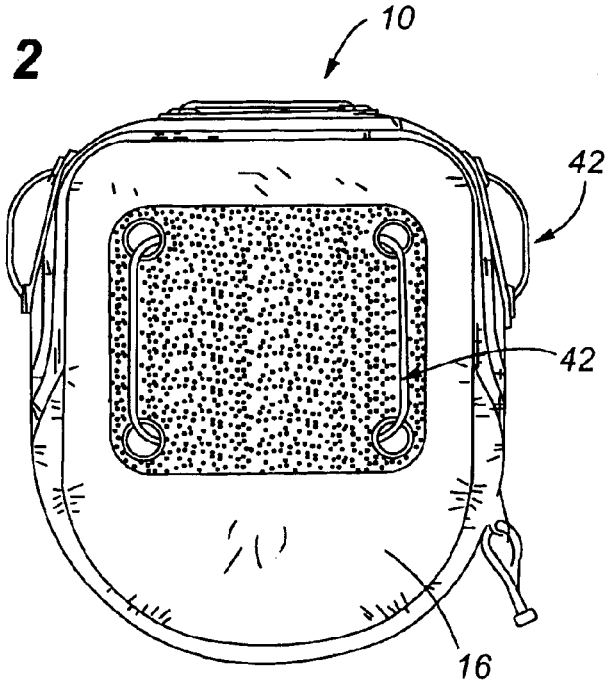
FIG. 4 is a rear elevation view of the invention shown in FIG. 1.

Referring now to FIGS. 1–3, a fluid-resistant access means in one embodiment of the present invention is shown in use with the protective enclosure 10. In order to substantially impede liquids from penetrating the inside of the enclosure 10, in one embodiment of the present invention a protective sheath 22 is utilized. Preferably, the sheath 22 is interconnected onto the front 15 or rear 16 portion of the enclosure 10. The sheath 22 is interconnected to the enclosure 10 preferably by stitching, but one skilled in the art will appreciate many other methods of interconnection are possible which will impede fluid transfer from the outside; such as adhesive, riveted hardware, etc. The sheath 22 provides a substantially waterproof engagement to an aperture 24, which is integrated into a portion of the enclosure 10, and which allows an auxiliary device such as a headphone cable to penetrate therethrough.

More specifically, a "line-out" device 26, is provided, that is adapted to pass through the aperture 24 and fit snugly in the sheath 22 as shown. In one embodiment of the present invention, the line-out device 26 is a conductive electrical cord, with male 28 and female 30 ends, which is intended to be an extension cord that is accessed by the user's headset cord, for example. In one embodiment the female end 30, which is of a larger diameter than the line-out device's cord, fits snugly in the sheath and effectively provides a fluid resistant seal. It is important to note that the female end 30 does not necessarily have to be completely surrounded by the sheath 22. A portion of the female end 30 may rest against the enclosure 10 surface adjacent to the aperture 24 which, with the aid of the sheath 22, provides a fluid resistant barrier.

Figure 3A:
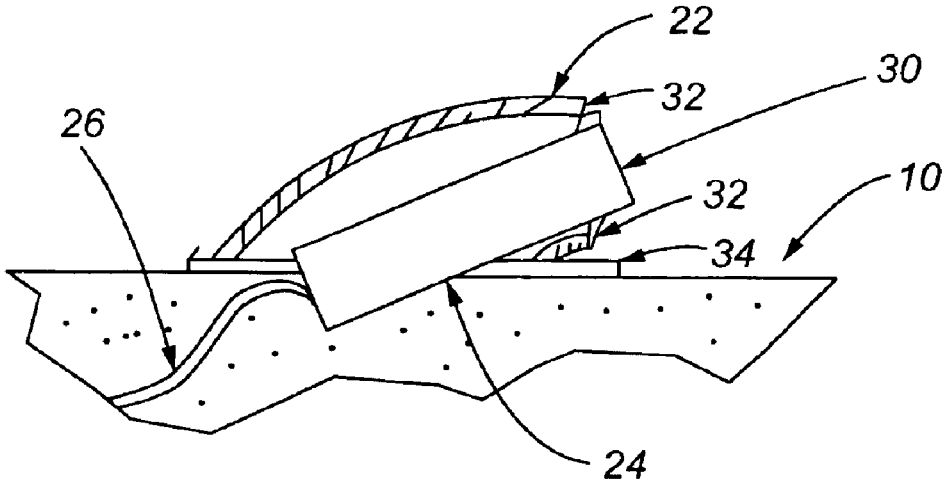
FIG. 3*a* is a partial auxiliary section view of another embodiment of the present invention shown in FIG. 3.

Referring now to FIG. 3*a*, another embodiment of the sheath 22 is provided herein. As described above, the sheath 22 acts as a cover for the aperture 24 and as a sealing means when it is selectively interconnected to an end of a line-out device 26. In order to provide greater protection from the infiltration of fluid into a protective enclosure 10, in an alternative embodiment of the present invention a flexible seal 32 is provided. More specifically, the seal 32 is interconnected to the sheath 22 and is adapted to receive a portion of the line-out device 26, thereby completely surrounding the female portion 30. The seal 32 may be constructed from rubber, neoprene, or any other substantially resilient material commonly known in the art that is water resistant. Alternatively, compression fit hardware and associated resilient bushings and/or gaskets may be utilized to provide the same function of a watertight seal. In another embodiment of the present invention a secondary seal 34 is provided which is interconnected to an outside surface of the enclosure 10, to provide even greater protection from the infiltration of foreign objects such as dust or moisture. Finally, in yet another embodiment of the present invention the sheath 22 may be constructed entirely from a resilient and/or fluid resistant material such that when a portion of the line-out device 26 is interconnected to it, the resilient nature of the material will provide a tighter seal.

Figure 3B:
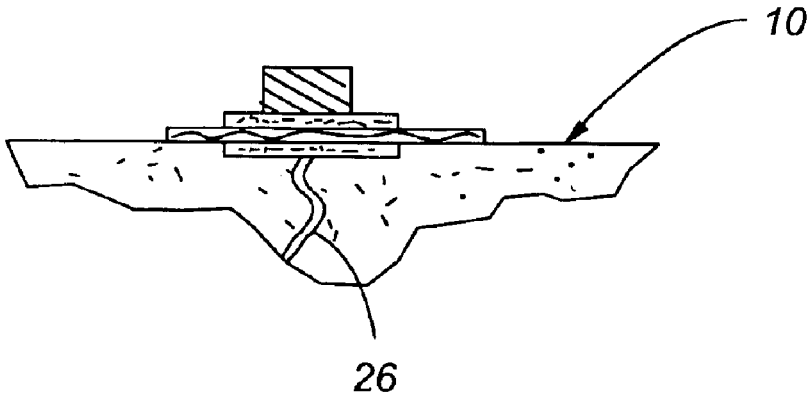
FIG. 3*b* is a partial auxiliary section view of another embodiment of the present invention shown in FIG. 3.
Figure 5:
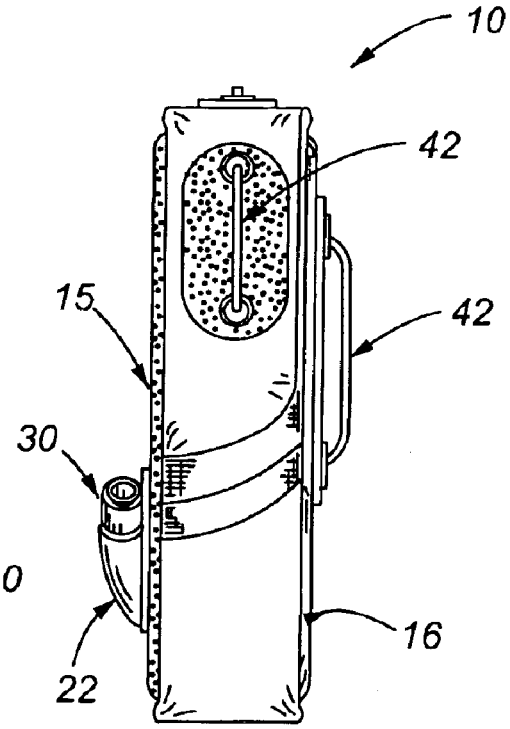
FIG. 5 is a right elevation view of the invention shown in FIG. 1.
Figure 6:
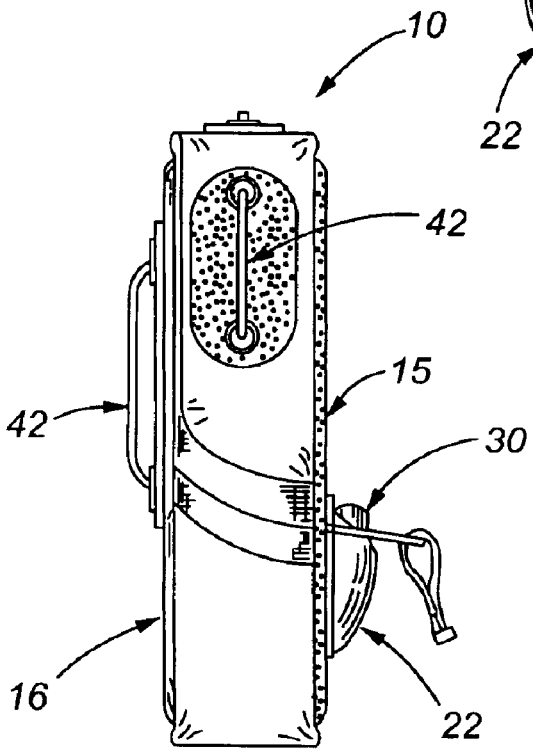
FIG. 6 is a left elevation view of the invention shown in FIG. 1.
Figure 7:
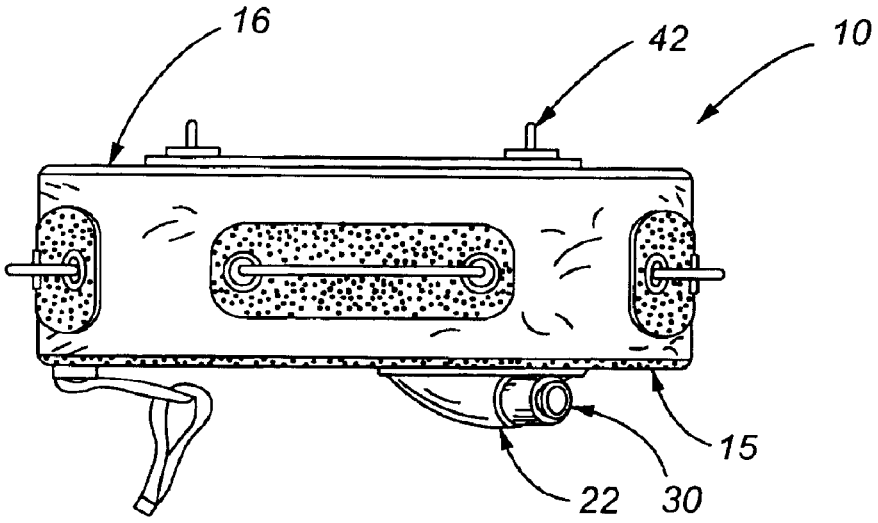
FIG. 7 is a top plan view of the invention shown in FIG. 1.
Figure 8:
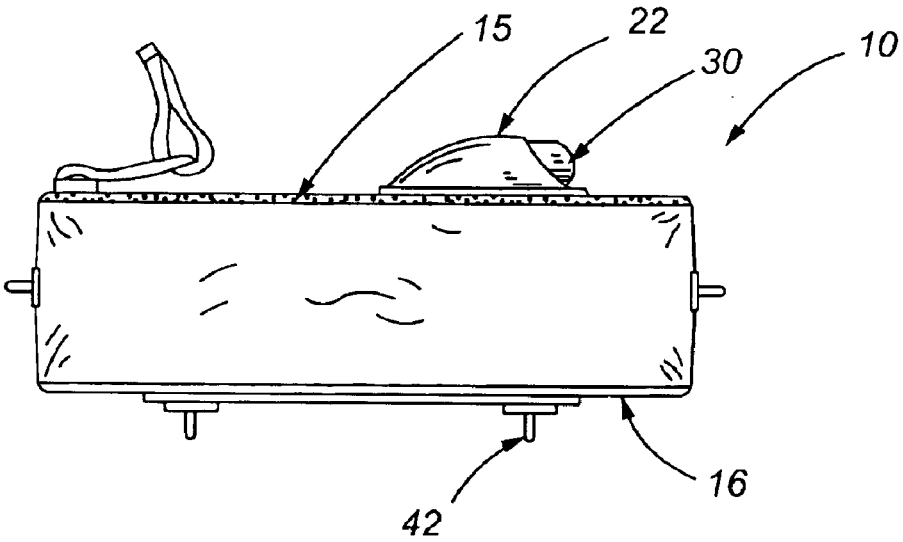
FIG. 8 is a bottom plan view of the invention shown in FIG. 1.

Referring now to FIG. 3*b*, another embodiment of the water resistant port is described herein. More specifically, in this embodiment a water-tight access port is provided which is interconnected to a protective enclosure 10 and omits the need for a sheath, as shown. In this embodiment a line-out device 26 is securely interconnected to the enclosure 10. A threaded interface 34 provides a location where a headset or other listening device is selectively interconnected. An interface 34 as described herein has the added benefit of insuring the user's output device does not disconnect at undesired times.

Referring again to FIGS. 1–8, additional aspects of the present invention are described herein. In one embodiment of the present invention, additional storage pockets 36 are provided, for holding CDs, for example. The storage pockets 36 may be attached to the inner surface of the rear portion 16 of the enclosure 10, or alternatively an additional panel 40 may be provided which is operably interconnected to an inner surface of the enclosure 10. Preferably, the panel 40 is constructed of padded material to provide greater protection to the electronic device carried within. In addition, the enclosure 10 may be provided with securing locations 42 wherein a strap 44 may be attached or that are adapted to receive a belt. Finally, as appreciated by one skilled in the art, the enclosure 10 may be constructed of materials of various colors or a combination thereof and may be adapted to display advertisements, company logos, etc.

In order to protect the electronic device, a user places the device into the storage compartment 14 of the protective enclosure 10. Other items such as, but not limited to, music media, keys, credit cards, and currency can be stored in the additional pockets 36. For example, in one embodiment of the present invention, the storage compartment 14 is capable of accepting a portable CD player, while the pockets 36 are capable of receiving CDs. Next, the line-out device 26, which is adapted to be used with the electronic device, is selectively interconnected to the electronic device. The other end of the line-out device 26, is then engaged with the aperture 24 of the enclosure and operably interconnected to the sheath with a snug interference fit to provide a substantially watertight seal. Finally, the user selectively interconnects the output device, i.e., headphones or other tape device to the portion of the line-out device accessible from the exterior of the enclosure 10, and selectively interconnects the front portion 15 and the rear portion 16 to ensure substantially complete protection against impacts and penetration from fluids, dust, etc.

To assist in the understanding of the present invention, the following list of components and associated numbering found in the drawings is provided herein:

Component

10 Protective enclosure

14 Electronic device storage compartment

15 Front portion of enclosure

16 Rear portion of enclosure

17 Transparent material

18 Selective interconnection means

22 Sheath

24 Aperture

26 Line-out device

28 Male end of line-out device

30 Female end of line-out device

32 Flexible seal

34 Threaded interface

36 Storage pocket

40 Panel

42 Securing location

44 Strap

While various embodiments of the present invention have been described in detail, it is apparent that modifications and abdications of those embodiments will occur to those skilled in the art. However, it is to be expressly understood that such modifications are within the scope and spirit of the present invention, as set forth in the following claims.

What is claimed is:

1. An enclosure adapted for holding and protecting an electronic device, comprising:

a front portion selectively interconnected to a rear portion, wherein said enclosure may be selectively opened and closed;

an electronic device storage area positioned between said front portion and said rear portion;

an aperture in said enclosure which is adapted for allowing penetration of said enclosure by a conductive auxiliary cord; and a sheath interconnected to said enclosure, and which is adapted to receive and sealingly engage the conductive auxiliary cord.

2. The enclosure of claim 1 further comprising at least one of a handle, a strap or a belt which is operably interconnected to said enclosure.

3. The enclosure of claim 1, wherein at least one of said front portion and said rear portion comprises at least one section of transparent material, wherein at least a portion of said electronic device can be viewed.

4. The enclosure of claim 1, wherein said storage area is adapted to receive at least one of a CD player, a MP3 player, a tape player, a mini-CD player, a cellular phone, a two-way radio, and a radio receiver.

5. The enclosure of claim 1, further comprising at least one storage pocket interconnected to at least one of an inner surface of said rear portion and said front portion.

6. The enclosure of claim 1, further comprising at least one storage pocket interconnected to an outer surface of at least one of said front portion and said rear portion.

7. The enclosure of claim 6, wherein said storage pocket is adapted to receive at least one compact disc.

8. The enclosure of claim 1, further comprising a protective panel interconnected to at least one of said rear portion and said front portion, wherein said electronic device is substantially protected from impact.

9. The enclosure of claim 8, further comprising storage pockets interconnected to said protective panel.

10. The enclosure of claim 1, wherein said sheath is comprised of at least one of a neoprene, a rubber, a treated leather, a nylon, a plastic, a silicon, and combinations therein.

11. The enclosure of claim 1, wherein said sheath is substantially waterproof.

12. The enclosure of claim 1, wherein said front portion and said rear portion are comprised of a water resistant material.

13. The enclosure of claim 1, wherein said front portion is selectively interconnected to said rear portion with at least one of a zipper, a hook and loop material, a snap and a button.

14. A weather resistant, portable enclosure adapted to hold a portable electronic device, comprising:

a front portion, selectively interconnected to a rear portion, wherein said enclosure may be selectively opened and closed;

at least one pocket integrated into said portable enclosure;

an aperture located on at least one of said front portion and said rear portion which is adapted to receive a conductive auxiliary cord therethrough;

an auxiliary cord, which includes at least two ends, wherein a first end is adapted for selective interconnection to the portable electronic device; and a sheath positioned proximate to said aperture which is adapted to selectively secure a second end of said auxiliary cord to said enclosure, wherein a headset adapted to be used with said portable electronic device may be selectively interconnected to said second end of said auxiliary cord.

15. The portable enclosure of claim 14, wherein said sheath is comprised of a substantially water resistant material.

16. The portable enclosure of claim 15, wherein said sheath is comprised of at least one of a silicon, a rubber, a plastic, a leather material, a nylon, a polypropylene and a neoprene.

* * * * *